106-84 AU 115 EX
10/4/77 XR 4,052,641

United States Patent [19]

Dominick et al.

[11] 4,052,641

[45] Oct. 4, 1977

[54] ELECTRICALLY CONDUCTIVE COATING IN CATHODE RAY TUBE

[75] Inventors: Ellen K. Dominick; Dale R. Wexell, both of Corning, N.Y.

[73] Assignee: Corning Glass Works, Corning, N.Y.

[21] Appl. No.: 688,977

[22] Filed: May 24, 1976

Related U.S. Application Data

[63] Continuation-in-part of Ser. No. 558,276, March 14, 1975, abandoned.

[51] Int. Cl.[2] ..... H01J 29/00; H01J 31/00

[52] U.S. Cl. ..... 313/450; 313/479; 106/84

[58] Field of Search ..... 313/450, 479, 480

[56] References Cited

U.S. PATENT DOCUMENTS

| | | | |
|---|---|---|---|
| 2,151,992 | 3/1939 | Schwartz | 313/450 |
| 2,162,391 | 6/1939 | Schwartz et al. | 313/450 |
| 2,223,924 | 12/1940 | Stephan | 313/479 X |
| 2,699,510 | 1/1955 | Smelt | 313/450 X |
| 3,108,906 | 10/1963 | Scharrer et al. | 313/450 X |
| 3,295,008 | 12/1966 | Gallaro et al. | 313/450 X |
| 3,715,224 | 2/1973 | Campbell | 106/74 |

*Primary Examiner*—Robert Segal
*Attorney, Agent, or Firm*—Clinton S. Janes, Jr.; Clarence R. Patty, Jr.

[57] ABSTRACT

An improved conductive coating for the inner wall of a cathode ray tube is disclosed. The coating consists essentially of 5–25% of at least one of the alkali metal oxides $Na_2O$, $K_2O$ and $Li_2O$, 20–80% $SiO_2$, 2–25% of at least one oxide selected from the group consisting of $Ag_2O$, CuO, CdO, CaO, SrO, BaO, CoO, PbO, MgO, HgO, NiO, ZnO, and MnO, 10–50% carbon, and 0–50% of a filler pigment, the total content of silica plus pigment being 45–85%.

8 Claims, 1 Drawing Figure

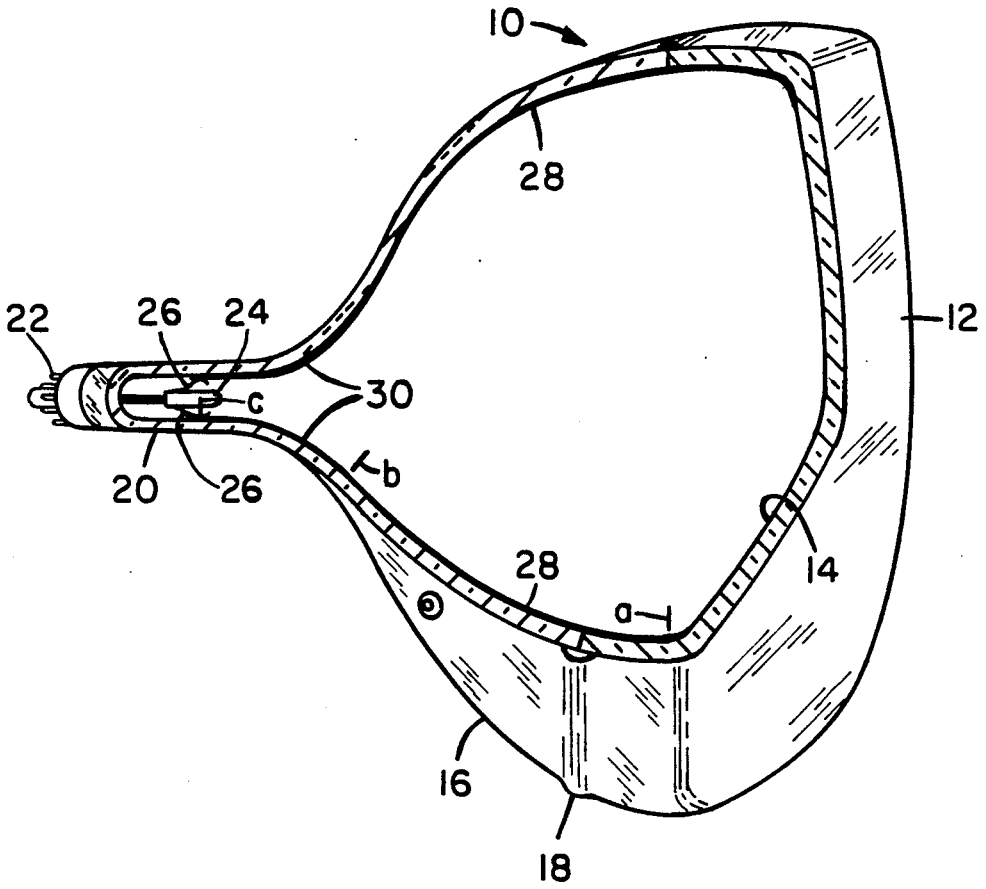
10
28
22
26
24
12
30
c
20
26
b
28
14
a
16
18

ELECTRICALLY CONDUCTIVE COATING IN CATHODE RAY TUBE

RELATED APPLICATION

This application is a continuation-in-part of my pending application Ser. No. 558,276, filed Mar. 14, 1975, now abandoned.

BACKGROUND OF THE INVENTION

A cathode ray tube, such as the well-known television tube, customarily consists of a panel or faceplate upon which the viewing screen is mounted, a neck portion within which an electron gun is mounted, and a funnel portion which separates the screen and gun. In operation, a large voltage drop is imposed between the screen and the electron gun, whereby electrons generated by the gun are impelled toward the screen. As a consequence, electric charges develop within the tube, and it has been the practice to provide an electrically conductive coating on the inside of the funnel portion. This conductive coating serves to drain off these charges and otherwise establish electrical contact between an electrical contact button in the tube wall and both the screen area and the gun area in the neck.

One early type of conductive coating is described in U.S. Pat. No. 2,699,510 which discloses the application of an enamel to the metal cone (now termed funnel) of a cathode ray tube. The operable enamels were required to have high melting points (800°-1100° C.). Where desired, the enamel, in fine particulate form, was mixed with about 5-10% by weight of graphite and the mixture applied to the metal cone by means of a liquid vehicle by spraying, immersion, or some other process. The single working example illustrated firing an enamel-graphite mixture on an iron core at 1100° C. The use of graphite in amounts exceeding 10% was stated to adversely affect the mechanical resistance of the resultant layer.

The coating traditionally used has been referred to as a "dag" coating. This coating consists essentially of colloidal carbon suspended in an alkali metal silicate, in particular sodium silicate. The coating is applied by suspending colloidal carbon in an aqueous solution of alkali metal silicate, painting or spraying a very thin layer of the suspension over the inside surface of a tube funnel, and then drying to a thin adherent coating normally not over a mil in thickness.

The "dag" coating has been well received because of its suitable electrical characteristics, ease of application, and low material cost. Nevertheless, its use has not been without problems. In particular, this coating does not weather well, tending to form crystalline patches. These may differ markedly in expansion from the underlying glass, thus causing cracking during processing, and/or reaction with moisture resulting in alkaline attack on the glass. Also, there is a tendency for particle flaking to occur within the tube due to poor adherence of the coating. Such particles may lodge in the shadow mask of a color tube, may lodge on the screen, or may cause arcing in the neck portion.

Accordingly, efforts have been made to use other materials, but these have either been too expensive, or have themselves not provided adequate adherence and durability. The need for good durability and weathering characteristics becomes particularly critical when coated tubes must either be stored or transported under humid conditions before final assembly.

A variation in the traditional "dag" coating is disclosed in U.S. Pat. No. 3,108,906 which describes the application of graphite-containing, conducting coatings to the inner surface of the glass funnel portion of a cathode ray tube. The coating comprises an aqueous suspension containing potassium silicate, graphite, and ZnO. The suspension, containing particulate ZnO which does not dissolve therein, is permitted to dry on the glass surface with the potassium silicate acting as an adhesive. Such coatings are highly crystalline. Since the ZnO is not dissolved in the potassium silicate solution, it has no substantial effect upon the chemical properties thereof. Its presence influences only the physical properties of the overall coating in its inclusion as a filler. The patent does not specify operable limits of graphite additions but the two exemplary compositions provided contained approximately 67% and 56% by weight, respectively.

OBJECTIVES OF THE INVENTION

It is then a primary purpose of the present invention to provide an improved cathode ray tube. More particularly, it is a purpose to provide an improved conductive coating on the interior of the funnel portion thereof. A specific purpose is to provide such conductive coating having improved physical and chemical characteristics as compared with previously used and proposed coatings.

SUMMARY OF THE INVENTION

We have now discovered that the previously known "dag" type coating can be modified to greatly improve its resistance to weathering and its adherence and cohesiveness, thereby providing an improved conductive coating for the funnel interior in a cathode ray tube. In particular, we have found that, if the alkali metal silicate previously combined with colloidal carbon is modified by including certain divalent ions, or monovalent ions other than alkali metals, the desired improvements may be achieved. We have further found that mixed silicate solutions for production of the new conductive coatings can be produced in accordance with procedures described in U.S. Pat. No. 3,715,224 granted Feb. 6, 1973 to L. E. Campbell.

Based on these findings, our invention is a cathode ray tube, wherein the funnel member has, over at least a portion of its interior wall, an electrically conductive coating composed essentially of, in weight percent of total solids, 5-25% total of at least one of the alkali metal oxides $Na_2O$, $K_2O$, and $Li_2O$, 20-80% $SiO_2$, 2-25% of at least one oxide selected from the group consisting of $Ag_2O$, CuO, CdO, CaO, SrO, BaO, CoO, PbO, MgO, HgO, NiO, ZnO, and MnO, 10-50% carbon, and 0-50% of a filler pigment, the total of silica plus pigment being 45-85%. In one embodiment of our invention, the conductive coating extends into the neck of the tube and has a composition and resistance in the neck portion differing from that over the funnel wall. Our invention further contemplates producing a cathode ray tube by mixing a solution of a complexed silicate of a non-alkali metal with an alkali metal silicate solution, suspending colloidal carbon, and optionally a filler pigment, in such mixture, applying the suspension in a thin film not over about 3 mils thick on the inside surface of a funnel portion of a cathode ray tube, drying the coating and thereafter sealing the funnel to a panel member at a temperature in the range of about 350°-525° C., preferably about 400°-450° C., whereby the coating is simultaneously fired to an adherent, glassy, somewhat porous coating not over about one mil in thickness.

DRAWING

The single FIGURE shows a partly cut away view of a conventional television picture tube illustrating application of the present invention.

GENERAL DESCRIPTION

Referring to the drawing, a television picture tube 10 is composed of a glass faceplate 12 having a phosphor screen applied over its inner surface 14, a glass funnel 16 sealed to the skirt of the faceplate along a seal line 18, and a glass neck portion 20 ending in a base 22 and having an electron gun 24 mounted therein. Gun 24 may have flexible members 26, known as snubbers, which bear against the inside wall of neck 20 when the gun is inserted in the neck.

It has been customary, heretofore, to apply an electrically conductive coating 28 over at least a portion of the inside surface of funnel 16. In particular, such coating is illustrated as extending between points "*a*" and "*b*" in the drawing and connecting a contact button, that extends through the wall of the funnel, with the screen and with the yoke (the neck-funnel junction), as is well known in the art. Heretofore, this conducting coating has been provided by the "dag" type coating described earlier; that is, a suspension of colloidal carbon in an alkali metal silicate carrier.

In accordance with our present invention, we provide a much improved coating 28 which consists of colloidal carbon suspended in an alkali metal silicate glass carrier modified by the presence of a non-alkali metal ion of I or II valence. Such modified carriers may be produced in accordance with the teachings of U.S. Pat. No. 3,715,224 mentioned earlier. As there disclosed, an ion selected from the group consisting of $Ag^{+}$, $Cu^{++}$, $Cd^{++}$, $Ca^{++}$, $Sr^{++}$, $Ba^{++}$, $Co^{++}$, $Pb^{++}$, $Mg^{++}$, $Hg^{++}$, $Ni^{++}$, $Zn^{++}$, and $Mn^{++}$, is reacted with a silicate ion and an organic acidic or amine complexing agent in the presence of water to produce a solution or suspension of a complexed silicate.

In accordance with our invention, such solution or suspension is then mixed with a suspension of colloidal carbon to provide a mixture yielding 10 to 50% by weight carbon, based on total solids, in a dried and fired product. This mixture is then applied to the glass tube funnel in known manner, e.g., by spraying or painting. The coating preferably corresponds to prior known "dag" coatings in physical characteristic; that is, has a thickness not exceeding 3 mils as applied and not over 1 mil as dried.

Conductive coating 28 is normally specified to have a resistance of 5000 ohms/square unit or less, preferably 500 to 2500 ohms/square unit, in the fired state. While resistance is commonly specified in ohms/square unit of surface, actual measurements are customarily made in ohms/linear inch by contacting the coating with probes spaced an inch apart. The values are usually taken as the same although the linear values may be slightly higher. This expedient is resorted to because of the curved surface on a cathode ray tube funnel.

Resistance in this coating is a function of carbon content with the resistance increasing with decreasing carbon content. The values tend to become essentially infinite below about 10% carbon, presumably because of lack of particle to particle contact. We have found that the carbon content may extend up to about 50% before it becomes too great to provide a smooth hard film when fired. However, carbon contents in the range of 25–40% by weight of total solids generally provide desired resistance values, the optimum carbon content depending to some extent on other coating components.

The components in our present coating are, as indicated above, specified in percent by weight on the basis of total solids in a dried and/or fired state. In general, such coating will consist of one or more of the alkali metal oxides, $Li_2O$, $Na_2O$, and $K_2O$, one or more of the indicated non-alkali metal oxides of Groups I and II, silica, carbon, and, optionally, a filler pigment as discussed later. It is convenient to consider the new coating as a two or three component system wherein the pigment, if present, and the carbon are treated as individual components, and the metal oxides and silica as a silicate system. Thus, the coating may contain up to 50% of a filler pigment before chalking or flaking occurs to an unacceptable degree. Also, as discussed above, the carbon constitutes 10 to 50% of the coating depending on the resistance value desired.

The silicate system will constitute 30 to 90% of the coating with the total metal silicate content being subdivided into 10 to 25% alkali metal oxide, 2 to 25% non-alkali metal oxide, and 60 to 80% silica. The optimum contents of the metal oxides will depend somewhat on the particular oxides selected. For example, we prefer to use a potassium silicate solution as the source of alkali metal oxide because the fired coating tends to be more durable while still providing a coefficient of thermal expansion that is compatible with that of the glass to which it is applied. When this alkali metal is selected for use in conjunction with zinc oxide, we find the alkali metal oxide content should be 15 to 25% while the ZnO content should be 2 to 12%. However, when copper oxide is used, the alkali content may be 10 to 25% and the copper oxide 2 to 25%.

One having general knowledge in the glass art can easily substitute soda and/or lithia for potassia in accordance with known glass making principles. Likewise, while zinc oxide is our preferred non-alkali metal oxide component, again substitutions of other oxides will be a matter of ordinary skill particularly in view of the disclosure in U.S. Pat. No. 3,715,224.

Our coating, in another form, may be used to suppress arcing between electron gun parts. Such an arc suppression coating 30 may extend over the yoke section of the tube and into the neck at least beyond the gun snubber points of contact, illustrated as between points "*b*" and "*c*" in the drawing. Unlike funnel coating 28, arc suppression coating 30 requires a relatively high resistance, preferably in the range of $10^5$ to $10^6$ ohms/square unit. For this range of resistance values, we find that a carbon content in the range of 10–20% is generally satisfactory. It will be appreciated of course that here also resistance will vary somewhat with the carrier composition, as well as with the coating thickness and conditions of firing.

The procedure for forming silicate solutions containing cations of the Group II and non-alkali Group I metals is described in detail in U.S. Pat. No. 3,715,224, and reference is made thereto for such disclosure. Briefly, a compound of the selected cation or cations is reacted in water with an organic chelating or complexing agent and a silicate ion to yield an aqueous solution or suspension of the complexed metal silicate. This may then be mixed with an alkali metal silicate to provide a mixture that may be dried and fired to form an insoluble, glassy mass. Further description of the complexed silicate material and its preparation are omitted in view of the detailed teaching in the patent.

For present purposes, colloidal carbon, or preferably an aqueous suspension, is mixed with the complex silicate solution. The amount of carbon added will be controlled depending on the resistivity value desired in the final product. Also, the vehicle content in the mixture will be controlled to provide the viscosity desired for application. Thus, the viscosity of a suspension for spray application may be adjusted to flow into and through the spray device, but not to flow or run on the sprayed funnel wall.

In actual practice, lack of adequate care, plus the curved nature of the surface being coated, lead to coating flow and areas of relatively thick application. As these thicker areas dry, there is a tendency for cracking of the coating and/or lack of adhesion to the glass to occur. This may be corrected in different ways. An absolutely clean glass surface, such as one resulting from acid fluoride washing, usually is sufficient, but may not be feasible. Inclusion of a filler pigment, such as iron oxide, silica, or alumina, in amount up to 50%, preferably 25–45%, will produce a coating that will "breathe" during drying, and thus avoid cracking.

Once a film has been applied to a tube wall, it may be air dried, but usually will be heated gently to hasten the drying process. The dried film then must be fired to remove the organic matter of the complexing agent completely. This is necessary to avoid gas evolution or other contamination in a sealed tube. Preferably, the coating is fired to a hard, smooth glassy film wherein the carbon is suspended in a modified alkali metal silicate carrier.

The firing temperature will vary with the modifying cation selected, as well as the complexing agent selected. It is of course necessary to completely dissociate the complexed metal silicate, and the firing temperature required depends on the stability of the complex. Accordingly, we prefer to use a zinc ion modifier for the complexed silicate because this has been found to form the least stable, and hence most easily dissociated, complex silicate. In particular, a zinc modified silicate complexed with an organic amine complexing agent can be dissociated, and the complexing agent completely removed, by firing at a temperature of 400° C., or even lower in some instances.

It is frequently desirable to combine the final firing of the coating with the sealing process where a soft glass seal is being made between the funnel and faceplate portions of the tube. In general such seals are made at temperatures in the range of 350°–525° C., and most customarily at 400°–450° C., and a coating mixture may readily be formulated to permit simultaneous firing. Temperatures greater than about 525° C. hazard deformation of the glass faceplate and funnel portions.

Another factor to consider in selecting a modifying ion is the chemical stability of the ion during firing, particularly with respect to oxidation-reduction. Thus, copper is a very flexible and useful cation in the preparation of complex solutions. However, it does have a tendency to reduce to the metal during firing. Therefore, one must either forego the use of copper or avoid strong reducing conditions.

Both high resistance coatings, such as arc suppression coating 30, and low resistance coatings, such as funnel coating 28, may be produced by adding a suitable amount of colloidal or powdered graphite to an aqueous silicate solution stabilized with the addition of a complexing agent and an alkali silicate solution. As explained in the Campbell patent, the complexing agent selected will depend in part on the metal silicate employed. Thus with zinc or copper silicate solutions we prefer diethylenetriamine (DETA). The mole ratio of silica ($SiO_2$) to total metal oxide including alkali metal oxide should not exceed 1:2 for a useful coating material. Likewise, it is preferred that the molar ratio of metal oxide (CuO or ZnO) to complexing agent be at least 1:1 to obtain glassy, particle free, non-flaking coatings after firing.

SPECIFIC EMBODIMENTS

The invention is further described with reference to specific examples which should be understood as illustrative, and not limiting. In particular, these examples are primarily directed to zinc and copper base coatings, since these are considered most useful. However, one skilled in this art, and having the present description supplemented by that of the Campbell patent mentioned earlier, can, without further instruction, readily produce and determine the characteristics of coatings based on other metal ions in accordance with the invention.

EXAMPLE 1

Thirty grams of reagent grade copper silicate ($CuSiO_3$) was reacted with 22.2 grams of diethylenetriamine (DETA) while stirring the mixture. The reacted mixture was then combined with 47.8 grams of distilled water and mixed by rolling in a plastic bottle for 12 hours. Meanwhile a mixture of 24.55 grams colloidal graphite in water (18.3% carbon), 5 grams of distilled water and 89.69 grams of potassium silicate solution (20.8 weight percent $SiO_2$ and 8.3 weight percent $K_2O$) was prepared. The latter was then combined with 47.37 grams of the complexed $CuSiO_3$ solution and this mixture homogenized by again rolling for 12 hours in a plastic bottle.

The components of the final mixture may be considered either in terms of "weight percent of solution" or "weight percent solids", as shown in the following table:

TABLE I

| | Solution | Solids |
|---|---|---|
| CuO | 4.84 | 17.64 |
| $SiO_2$ | 14.90 | 54.29 |
| DETA | 6.27 | — |
| $H_2O$ | 66.28 | — |
| $K_2O$ | 4.47 | 16.27 |
| C | 3.24 | 11.81 |

The mixture of graphite and silicate solution, as shown in TABLE I, was then sprayed on the inside surface of a rectangular funnel for a 19 inch cathode ray tube to provide a continuous resistance coating not over 3 mils thick. The funnel was dried and then sealed to a skirted glass faceplate using a conventional frit glass sealing schedule as follows:

25° to 100° C. at 3.5° C./minute
Hold 100° C. for 30 minutes
100° to 410° C. at 8° C./minute
Hold 410° C. for 15 minutes
Cool to 25° C. at 4° C./minute No additional heating was required, and the coating fired to a hard, smooth, shiny black coating of approximately 1 mil thickness. The resistance of the fired coating, as measured with a commercial ohmmeter, was 5.63 $\times 10^5$ ohms/inch, which meets the arc suppression specification of $10^5$ to $10^6$ ohms per square.

When the resistance coating thus produced was subjected to applied volatages of varying magnitude, it was found that arcing did not occur until the voltage exceeded about 3000 volts. Likewise, as shown in the table below, electrical stability in air remained stable up to an applied voltage of 2500 volts.

TABLE II

| Volts (V) | Amps (amp) | Resistance (ohms) |
|---|---|---|
| 20 | $6.6 \times 10^5$ | $3.03 \times 10^5$ |
| 100 | $7.89 \times 10^5$ | $1.27 \times 10^6$ |
| 500 | $7.7 \times 10^5$ | $6.49 \times 10^6$ |
| 1000 | $7.8 \times 10^5$ | $1.28 \times 10^7$ |
| 1500 | $7.8 \times 10^5$ | $1.92 \times 10^7$ |
| 2000 | $7.75 \times 10^5$ | $2.58 \times 10^7$ |
| 2500 | $7.75 \times 10^5$ | $3.23 \times 10^7$ |

Similar coating compositions were prepared and applied to television tube funnels in the manner described in Example 1, the only essential variation being in the proportions of the components mixed together and the consequent proportions and resistance characteristics in the final coating. The component proportions, both in "Weight Percent Solution" and "Weight Percent Solids", are shown in the following table, together with the resistance (R) in ohms per inch as measured on the fired coating.

TABLE III

| | Resistor Coating Compositions | | | | | |
|---|---|---|---|---|---|---|
| | 2 | | 3 | | 4 | |
| | Wt. % Solution | Wt. % Solids | Wt. % Solution | Wt. % Solids | Wt. % Solution | Wt. % Solids |
| CuO | 4.29 | 16.05 | 4.87 | 19.29 | 5.50 | 21.39 |
| $SiO_2$ | 12.68 | 47.40 | 11.80 | 46.68 | 13.35 | 51.88 |
| $K_2O$ | 3.75 | 14.04 | 3.23 | 12.79 | 3.66 | 14.21 |
| C | 5.98 | 22.39 | 5.38 | 21.30 | 3.22 | 12.51 |
| $H_2O$ | 67.75 | | 68.42 | | 67.17 | |
| DETA | 5.55 | | 6.29 | | 7.11 | |
| R (ohms/in.) | $2.05 \times 10^3$ | | $2.82 \times 10^3$ | | $1.63 \times 10^4$ | |
| | 5 | | 6 | | 7 | |
| | Wt. % Solution | Wt. % Solids | Wt. % Solution | Wt. % Solids | Wt. % Solution | Wt. % Solids |
| CuO | 4.87 | 17.64 | 2.57 | 10.34 | 2.06 | 8.37 |
| $SiO_2$ | 15.38 | 55.60 | 12.45 | 49.47 | 12.33 | 50.56 |
| $K_2O$ | 4.65 | 16.92 | 4.17 | 16.75 | 3.81 | 14.22 |
| C | 2.72 | 9.84 | 5.71 | 22.92 | 6.63 | 26.85 |
| $H_2O$ | 66.07 | | 71.77 | | 72.03 | |
| DETA | 6.30 | | 3.33 | | 3.14 | |
| R (ohms/in.) | $1.3 \times 10^6$ | | $5.5 \times 10^3$ | | $2.1 \times 10^3$ | |

Example 6 represents a slight variation in raw materials. Here a suspension of graphite powder of about 325 mesh size was used instead of colloidal graphite which is a true colloidal suspension of finer particles. Care must be taken to keep the powder in suspension, and to avoid delays in use whereby settling occurs.

EXAMPLE 8

A mixture was prepared by stirring 118.8 grams of reagent grade zinc oxide into 302 grams of diethylenetriamine while the latter was chilled in ice. When there was no further evidence of reaction in the mixture, 702.8 grams of a 40% colloidal silica solution were added slowly with stirring. The resulting solution was rolled for 3 days in a plastic container to produce a translucent, homogeneous solution.

A second mixture was produced by mixing 681.8 grams of a colloidal graphite containing 22% carbon with 859.2 grams of potassium silicate (20.8 wt.% $SiO_2$ and 8.3 wt.% $K_2O$) solution in a plastic container. Then 280.9 grams of the first solution were added to this second solution to produce a third mixture which was then homogenized by rolling for 24 hours. The viscosity of the third solution was then adjusted to about 400 centipoises for application purposes by adding 523.8 grams of distilled water. This final solution was composed of the following components in the indicated percentage by weight proportions on a solution and a total solids basis:

TABLE IV

| | Wt. % Solution | Wt. % Solids |
|---|---|---|
| ZnO | 1.65 | 5.99 |
| $SiO_2$ | 13.68 | 49.82 |
| $K_2O$ | 3.91 | 14.25 |
| C | 8.22 | 29.94 |
| $H_2O$ | 68.36 | — |
| DETA | 4.18 | — |

The solution was painted or brushed on the interior surface of a television tube funnel, as in Example 1, in conventional manner to provide a conductive coating between the anode button and the tube screen. This was dried and fired on a sealing schedule as detailed in Example 1, except that the maximum temperature was 450° C. The fired coating had a resistivity of 1000 ohms per inch as measured with an ohmmeter in air at room temperature.

EXAMPLES 9-14

Similar coating compositions were prepared and applied to television tube funnels in the manner described in Example 8, the only essential variation being in the proportions of the components mixed together and the consequent proportions and resistance characteristics in the final coating. The component proportions, both in "Wt.% Solution" and "Wt.% Solids" are shown in the following table, together with the resistance (R) in ohms per inch as measured on the fired coating.

TABLE V

| | 9 | | 10 | | 11 | |
|---|---|---|---|---|---|---|
| | Wt. % Solution | Wt. % Solids | Wt. % Solution | Wt. % Solids | Wt. % Solution | Wt. % Solids |
| ZnO | 1.88 | 5.71 | 1.70 | 5.99 | 1.67 | 5.99 |
| $SiO_2$ | 19.44 | 59.07 | 16.12 | 56.95 | 14.89 | 53.39 |
| $K_2O$ | 6.86 | 20.84 | 4.84 | 17.09 | 4.36 | 15.65 |
| C | 4.73 | 14.38 | 5.65 | 19.97 | 6.96 | 24.96 |
| $H_2O$ | 62.32 | | 67.38 | | 67.88 | |
| DETA | 4.77 | | 4.31 | | 4.24 | |
| R (ohms/in.) | $0.5 \times 10^6$ | | $1.5 \times 10^5$ | | $2 \times 10^4$ | |
| | 12 | | 13 | | 14 | |
| | Wt. % Solution | Wt. % Solids | Wt. % Solution | Wt. % Solids | Wt. % Solution | Wt. % Solids |
| Zno | 1.62 | 5.99 | 1.60 | 5.99 | 1.57 | 5.99 |
| $SiO_2$ | 12.51 | 46.25 | 11.38 | 42.69 | 10.27 | 39.10 |
| $K_2O$ | 3.47 | 12.82 | 3.03 | 11.38 | 2.62 | 9.98 |
| C | 9.45 | 34.94 | 10.64 | 39.94 | 11.80 | 44.93 |
| $H_2O$ | 68.84 | | 69.30 | | 69.75 | |
| DETA | 4.11 | | 4.05 | | 3.99 | |
| R (ohms/in.) | $2 \times 10^{03}$ | | $1.19 \times 10^3$ | | $6.34 \times 10^2$ | |

EXAMPLE 15

Six grams of hydrated nickel nitrate, $Ni(NO_3)_2 \cdot 6H_2O$, were reacted with 25 ml. of concentrated ammonia solution (15.4 M) and 2.2 grams DETA with stirring. The reacted mixture was then combined with 50 grams of potassium silicate solution (20.8 wt.% $SiO_2$ and 8.3% $K_2O$) with further stirring, and the mixture homogenized by rolling in a plastic container for 24 hours. The homogenized mix was then combined with 31.4 grams of an aqueous suspension of colloidal graphite (18.3% carbon) and further rolled for several hours to form a well-homogenized suspension.

The components of the final suspension are as follows in weight percent (wt.%):

TABLE VI

| | Solution | Solids |
|---|---|---|
| NiO | 1.41 | 6.70 |
| $SiO_2$ | 9.49 | 45.22 |
| DETA | 2.01 | — |
| ($NH_3$, $H_2O$, $NO_3^-$) | 77.00 | — |
| $K_2O$ | 3.79 | 18.04 |
| C | 6.30 | 30.00 |

The mixture, composed as just shown, was applied to a glass substrate and dried to form a layer approximating 1 mil in thickness. The dried coating was fired at approximately sealing temperature and a resistance of $3 \times 10^3$ ohms per inch measured with a commercial ohmmeter.

EXAMPLE 16

Three grams of hydrated cobalt acetate, $Co(CH_3COO)_2 \cdot 4H_2O$ were reacted with 25 ml. of concentrated ammonia solution and 2.2 grams DETA, and the reaction product rolled for several days. Then 25 grams of potassium silicate solution were added and the mixture rolled for another 12 hours. This mixture was then combined with 15.9 grams of an aqueous suspension of colloidal graphite and the final product rolled for several hours. It is advantageous to mix the potassium silicate and graphite into the complexed cobalt solution as soon as cobalt dissolution is complete to prevent gelation.

The components of this suspension, in weight percent (wt.%) are:

TABLE VII

| | Solution | Solids |
|---|---|---|
| CoO | 0.99 | 7.70 |
| $SiO_2$ | 5.70 | 44.52 |
| DETA | 2.41 | — |
| ($NH_3$, $H_2O$) | 84.78 | — |
| $K_2O$ | 2.28 | 17.81 |
| C | 3.84 | 29.97 |

When applied to a glass substrate as in Example 15 and fired, this mix produced a coating also having a resistivity of about $3 \times 10^3$ ohms per inch.

EXAMPLE 17

A zinc silicate solution was prepared, as in Example 8, by reacting 28.93 grams of zinc oxide with 76.69 grams of DETA. When the reaction was completed, a colloidal silica solution, composed of 68.26 grams $SiO_2$ and 107.07 grams water, was added and the mixture rolled to produce a translucent, homogeneous solution.

A second mixture was prepared by mixing 681.8 grams of a colloidal graphite with 644.23 grams of a sodium silicate solution in a plastic container. The first mixture was then added to the second to produce a third mixture which was homogenized by rolling. The viscosity of this third mixture was then adjusted for application by adding 641.1 grams of water and thoroughly mixing. The coating material thus produced was composed, in percent by weight and on both a solution and total solids basis, as follows:

TABLE VIII

| | Wt. % Solution | Wt. % Solids |
|---|---|---|
| ZnO | 1.32 | 6.13 |
| $SiO_2$ | 11.07 | 51.42 |
| $Na_2O$ | 2.46 | 11.42 |
| C | 6.68 | 31.03 |
| $H_2O$ | 75.11 | |
| DETA | 3.36 | |

When this material was applied to a glass surface in usual manner, dried and fired, a resistivity of 1200 ohms/inch was measured. This illustrates the use of an alkali metal silicate other than potassium silicate.

EXAMPLE 18

This example illustrates the inclusion of a filler pigment (iron oxide) and alumina in the coating composition.

A zinc silicate solution totaling 21.03 grams was prepared as in the preceding example by reacting 2.17 grams of zinc oxide with 5.74 grams of DETA, and adding colloidal silica composed of 5.11 grams $SiO_2$ and 8.01 grams water.

A second mixture was prepared by mixing 92.91 grams of colloidal graphite containing 22% carbon with 64.65 grams of potassium silicate (20.8 wt.% $SiO_2$ and 8.3 wt.% $K_2O$).

The first mixture was added to the second and homogenized, after which a third mixture was added. This was produced by mixing 15.12 grams iron oxide, 49.65 grams of 2.8 M ammonia solution and 30 grams water, and adding 10.19 grams of an acetate stabilized sol containing 26.7% $SiO_2$ and 4.1% $Al_2O_3$.

The final mix was composed, in percent by weight and on both a solution and total solids basis, as follows:

TABLE IX

| | Wt. % Solution | Wt. % Solids |
|---|---|---|
| ZnO | 0.77 | 3.37 |
| $SiO_2$ | 7.51 | 32.85 |
| $K_2O$ | 1.89 | 8.27 |
| C | 7.21 | 31.54 |
| $Fe_2O_3$ | 5.33 | 23.31 |
| $Al_2O_3$ | 0.45 | 0.66 |
| $CH_3COO^-$ | 0.22 | |
| DETA | 2.02 | |
| $NH_3$ | 17.51 | |
| $H_2O$ | 57.39 | |

This material was applied to a glass surface in usual manner, dried and fired, and a resistivity of 800 ohms per inch measured with a commercial ohmmeter.

We claim:

1. In a cathode ray tube comprising a glass faceplate upon which a viewing screen is mounted, a glass neck portion within which an electron gun is mounted, and a glass funnel portion having an electrically conductive coating on at least a portion of its inner wall, the improvement comprising a coating mixture fired at 350°-525° C. to a hard, smooth, glassy, electrically conductive coating exhibiting good durability and resistance to weathering, said coating consisting essentially, in weight percent of total solids, of 5-25% total of at least one of the alkali metal oxides $Na_2O$, $K_2O$, and $Li_2O$, 20-80% $SiO_2$, 2-25% of at least one oxide selected from the group consisting of $Ag_2O$, CuO, CdO, CaO, SrO, BaO, CoO, PbO, MgO, HgO, NiO, ZnO, and MnO, 10–50% carbon, and 0–50% of a filler pigment, the total of silica and pigment being 45–85%.

2. A cathode ray tube according to claim 1 wherein the electrically conductive coating connects the contact button in the wall of the funnel with the viewing screen.

3. A cathode ray tube according to claim 2 wherein the electrically conductive coating contains 25–40% carbon and has a resistivity of not over 5,000 ohms/square.

4. A cathode ray tube according to claim 1 wherein the electrically conducting coating extends over the yoke section connecting the funnel and neck portions of the tube.

5. A cathode ray tube according to claim 4 wherein the electrically conducting coating contains 10–20% carbon and has a resistivity on the order of $10^5$ to $10^6$ ohms/square.

6. A cathode ray tube according to claim 1 wherein the electrically conducting coating contains 25–45% of an inorganic filler pigment.

7. A cathode ray tube according to claim 1 wherein the electrically conducting coating contains $K_2O$ as the alkali metal oxide component.

8. A cathode ray tube according to claim 1 wherein the electrically conducting coating contains ZnO as the divalent metal oxide component.

* * * * *

UNITED STATES PATENT AND TRADEMARK OFFICE

CERTIFICATE OF CORRECTION

PATENT NO. : 4,052,641

DATED : October 4, 1977

INVENTOR(S) : Ellen K. Dominick and Dale R. Wexell

It is certified that error appears in the above-identified patent and that said Letters Patent are hereby corrected as shown below:

Column 8, line 54, Table V, Examples 12-14, constituent "Zno" should be -- ZnO --.

Column 8, line 59, Table V, Example 12, "2 X $10^{03}$" should be -- 2 X $10^{3}$ --.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*